US006244228B1

(12) United States Patent
Kuhn et al.

(10) Patent No.: US 6,244,228 B1
(45) Date of Patent: Jun. 12, 2001

(54) ROTARY-TO-LINEAR MOTION CONVERTER AND USE THEREOF

(76) Inventors: Damon Kuhn, Rte. 2 Box 340B, Frisco, TX (US) 75034; J. M. Johnson, 1131 Winterwood, Lewisville, TX (US) 75067-5037; Horace David Wright, P.O. Box 462193, Garland, TX (US) 75046

( * ) Notice: Subject to any disclaimer, the term of this patent is extended or adjusted under 35 U.S.C. 154(b) by 0 days.

(21) Appl. No.: 09/210,154

(22) Filed: Dec. 11, 1998

(51) Int. Cl.[7] ..... F01L 1/00; F16K 31/44

(52) U.S. Cl. ..... 123/90.1; 123/90.25; 74/57; 74/107; 74/424.8 VA; 74/559; 137/624.13; 251/251; 251/265

(58) Field of Search ..... 123/90.1, 90.15, 123/90.16, 90.17, 90.22, 90.24, 90.25, 90.27; 137/624.13; 251/251, 265; 74/57, 58, 107, 424.8 VA, 559

(56) References Cited

U.S. PATENT DOCUMENTS

| | | | |
|---|---|---|---|
| Re. 30,188 | | 1/1980 | Predhome, Jr. . |
| 1,850,544 | | 3/1932 | Gray . |
| 3,952,604 | | 4/1976 | Baudler . |
| 4,008,625 | | 2/1977 | Malhotra . |
| 4,022,076 | | 5/1977 | Metz . |
| 4,031,765 | | 6/1977 | Metz . |
| 4,256,065 | | 3/1981 | Hirt . |
| 4,343,200 | | 8/1982 | Alworth et al. . |
| 4,522,085 | | 6/1985 | Kane . |
| 4,799,644 | | 1/1989 | Gaianigo . |
| 5,016,581 | * | 5/1991 | Parsons ..... 123/90.25 |
| 5,078,102 | | 1/1992 | Matsumoto . |
| 5,099,805 | | 3/1992 | Ingalls . |
| 5,129,407 | | 7/1992 | Phillips . |
| 5,327,856 | | 7/1994 | Schroeder et al. . |
| 5,483,929 | | 1/1996 | Kuhn et al. . |

* cited by examiner

*Primary Examiner*—Weilun Lo
(74) *Attorney, Agent, or Firm*—George R. Schultz

(57) ABSTRACT

A rotary-to-linear converter for use with a valve actuation device having a linear reciprocating cam shaft having longitudinally extending cam grooves that are engaged by captive cam followers which oscillate up and down in response to sideways reciprocation of the camshaft for actuating intake or exhaust valves of internal combustion engines or other devices employing reciprocating pistons and valves. The camshaft is caused to reciprocate by a rotary linear converter of the "yankee" type composed of double helix channel at the extreme end of the camshaft and a rotary drive collar having two sets of diametrically opposed guide members. The guide members comprise dogs which are rotatably engaged with the drive collar and slidably engaged with the double helix channel of the cam shaft.

29 Claims, 10 Drawing Sheets

ROTARY-TO-LINEAR MOTION CONVERTER AND USE THEREOF

TECHNICAL FIELD OF THE INVENTION

This invention relates to devices for opening and closing valves on internal combustion engines, compressors, and oil field equipment. More specifically it relates to an improved device which reciprocatingly opens and closes a valve in response to rotary motion of a camshaft or crankshaft which allows gaseous or liquid fluid to either enter or escape cylinders engaged with a reciprocating piston

BACKGROUND OF THE INVENTION

The energy efficiency of an engine or compressor is directly proportional to the rate and volume of intake fluid drawn into a cylinder and of exhaust fluid expelled from the cylinder per stroke. The greater the flow rate of intake or exhaust fluid the greater the energy efficiency of the engine or compressor. The energy efficiency of an engine or compressor can be increased by varying the timing of the intake and exhaust values with respect to the speed of and to the load placed on the engine or compressor. Specifically, the point in time in which a valve opens or closes in relation to the position of a piston in a cylinder and the position of other valves may be adjusted to create optimal fluid flow rates. The optimal fluid flow rates vary depending on how fast the crankshaft is turning and what load is present on the engine or compressor.

Generally, an oblong cam rotatably engaged in time with a crankshaft is used to drive a push rod and rocker arm assembly to open a valve. A spring on a valve shaft closes the valve and maintains the rocker arm and push rod in contact with the rotating oblong cam. An oblong cam can also be used to drive a valve shaft directly, again employing a return spring to keep the valve shaft in contact with the cam at all times. In order to vary the timing and the length of time the valve is open, the cam diameter or attach angle must be changed responsive to the speed of the crankshaft.

Known oblong cam driven systems have several limitations. First, the combined speed of ascent and descent of the cam can only fall within a limited range. Ascent speed is limited by the mechanical connection between the cam and cam followers. If the ascent rate is too fast, shearing will occur at the cam follower surface. At high speeds, valve "float" is a problem, i.e., the valve is unable to close completely within a single full cycle of the cam. Valve float at high engine speeds occurs because the rate of closure of a valve is controlled by the stiffness of a return spring, and if the cam speed is too high, the strength of the valve return spring will be insufficient to close the valve before the cam begins a second cycle. The valve return spring must be strong enough to hold the exhaust valve shut during the intake stroke. However, if the valve return spring is too strong it will cause higher parasitic losses, strain on the valve train, and decrease energy efficiency of an engine. Reliance upon valve return springs is a second limitation in most known cam driven combustion engines.

Other mechanisms for opening and closing valves in cam driven systems are known. U.S. Pat. No. 5,078,102 to Matsumoto discloses a system wherein a rotating cam is replaced by a stepped cam plate which is disposed substantially perpendicular to the longitudinal axis of the camshaft. The sliding horizontal cam directly forces an opposing rocker arm up, thereby actuating a valve. The timing of an engine equipped with this valve opening system is changed by mechanically lengthening or shorting various mechanical control elements which change the relationship of the cam surface in response to crankshaft's angular position.

Stepped cam plate systems suffer several limitations. They are difficult to install on existing engines because the travel of the step cam plate is perpendicular to the rotational axis of the crankshaft and camshaft. These systems are also difficult to use in retrofitting existing engines, and the timing variation is accomplished by way of a complex hydraulic system which is difficult to install and maintain.

U.S. Pat. No. RE. 30,188 to Predhome, Jr. discloses a desmodromic cam and cam follower to convert rotation of a camshaft to rotary oscillation of the cam follower and in turn into activation of valves. The system is difficult to use in retrofitting existing engines and still employs return springs to close valves.

U.S. Pat. No. 5,483,929 to Kuhn et al. ("the Kuhn et al. '929 Patent") discloses a linear reciprocating camshaft having longitudinally extending cam grooves that are engaged by captive cam followers which oscillate up and down in response to sideways reciprocation of the camshaft. This device is used for operating intake and exhaust valves of machines, such as internal combustion engines or compressors, employing reciprocating pistons and valves. The camshaft is caused to reciprocate by a "yankee" type rotary-to-linear converter comprising a composite helical channel network on the surface of an end of the camshaft. The helical channel network comprises two continuous, complementary, oppositely threaded, intersecting and opposing helical channels. The helical channel network is engaged with a rotary driven collar by way of opposing triplets of radially spaced, freely rotating guide balls which engage complementary constraining slots and guide slots in the rotary driven collar. Each triplet of guide balls, which are further constrained by plural retaining clips, is engaged with its own helical channel.

Although, the reciprocating valve actuator-based system of the Kuhn et al. '929 Patent provides longer power cycles, improved energy efficiency, increased wear life, elimination of valve return springs, and increased horsepower over that provided by conventional internal combustion engines, it still possesses several disadvantages: 1) excessive wear of the reciprocating rod at turn-around points in the helical channels due to extremely high drive collar speeds; 2) guide ball breakage; and 3) complexity of the system due to an increased number of parts. Valve timing is changed by variably aligning the captive cam followers in relation to the cam grooves on the reciprocating camshafts. The shaft of each valve can be coupled to the captive cam follower so that the cam follower opens and closes the valve directly.

Given a continuing interest in the design and manufacture of energy efficient engines, there exists a need for an improved reciprocating valve actuator-based engine or compressor, and especially for one that requires lower drive collar rotational speeds, comprises less individual small components and is less prone to malfunction.

SUMMARY OF THE INVENTION

The device of the present invention seeks to overcome the above-mentioned disadvantages and deficiencies which are characteristic of the known art. The device of the present invention is an improved linear-to-rotary motion converter for use with a reciprocating valve actuator device. The rotary-to-linear converter comprises less individual small components than and has a reduced tendency to malfunction as compared to known linear-to-rotary converters. A reciprocating valve actuator employing the present rotary-to-linear converter includes a reciprocating rod which can reciprocate at about the same speed, in cycles per second, as a respective operably engaged cam shaft can rotate in cycles per second. The reciprocating rod employs a helical channel network having an increased helix angle, above that of known devices, such that it can reciprocate at about the same speed as a respective cam shaft, with respect to revolutions or reciprocations per minute. When compared to known devices, the reciprocating rod travels a greater linear distance for each revolution of the cam shaft. The diameter of the reciprocating rod with respect to that of the cam shaft is also larger than that of known reciprocating valve actuator-based devices. The guide ball system of known devices has been replaced by a pair of "dogs" that are engaged with the drive collar. The dogs are radially spaced apart approximately 180° apart and engage the helical channel network of the reciprocating rod. The dogs are advantageous over the known guide ball system in that at the upper-and lower-most points—the turn-around points—of the helical channel network, forces applied by the dogs to the reciprocating rod are reduced thereby making the present system less likely to fail at the turn around points than the known guide ball-based system.

One aspect of the present invention provides a rotary-to-linear converter, comprising:

(a) a reciprocating shaft extending along a first longitudinal axis and having a helical channel network on a radial surface of a first end;

(b) a rotating driver extending along a second longitudinal axis, said driver having an inner surface defining a bore at one end for receiving said first end of said reciprocating shaft; and (c) guide means engaged with said helical channel network of said reciprocating shaft and with said rotating driver, said guide means comprising at least one dog;

wherein:

said first longitudinal axis is substantially colinear with said second longitudinal axis; and at least said first end of said reciprocating shaft reciprocates within said bore of said rotating driver along said longitudinal axes when said rotating driver is continually rotated about said second longitudinal axis in a first radial direction; and said at least one dog has rounded ends.

The rounded ends of the dog will be oppositely disposed about a center portion and, together with an end of the center portion, the rounded ends will form an arc which is substantially complementary to an arcuate inner surface of the helical channel. The length of the dog as measured from one rounded end to the other will span a distance which is at least twice the width of one of the channels of the helical channel network. The rounded end of the dogs span a distance which is sufficiently small to permit the dog to course through a turnaround point in the helical channel network.

In another aspect, the present invention provides a reciprocating valve actuator device comprising at least one and preferably two rotary-to-linear motion converters according to the invention. Accordingly, another embodiment of the invention provides a valve actuator device for use in an internal combustion engine, the device comprising: one or more rotary-to-linear motion converters each comprising:

(a) a reciprocating shaft extending along a first longitudinal axis and comprising a helical channel network on a radial surface of a first end and one or more actuator slots;

(b) a rotating driver extending along a second longitudinal axis, said driver having an inner surface defining a bore at one end for receiving said first end of said reciprocating shaft; and (c) guide means engaged with said helical channel network of said reciprocating shaft and with said rotating driver, said guide means comprising at least one dog;

wherein:

said first longitudinal axis is substantially colinear with said second longitudinal axis; and at least said first end of said reciprocating shaft reciprocates within said bore of said rotating driver along said longitudinal axes when said rotating driver is continually rotated about said second longitudinal axis in a first radial direction;

a base which is engageable with an internal combustion engine and onto which is mounted said one or more rotary-to-linear motion converters;

one or more rockers slidably, pivotingly and operably engaged with said one or more reciprocating shafts such that linear reciprocation of said one or more reciprocating shafts will cause said one or more rockers to reciprocate and pivot about said one or more shafts; and one or more connectors for operably engaging said one or more rockers to one or more valves in said internal combustion engine;

wherein, said one or more rotary-to-linear motion converters are operably engaged with a crank shaft of said internal combustion engine.

The timing of an internal combustion engine comprising a valve actuator device according to the invention can be adjusted or change by at least one of:

(a) adjusting an operable engagement between said first and second rotary to linear converters;

(b) displacing said one or more rockers with respect to said rotating drive collar;

(c) adjusting a length of said one or more connectors operably engaging said one or more rocker arms to said one or more valves;

(d) changing a helix angle of said helical channel network;

(e) changing a gear ratio of said first rotary-to-linear motion converter relative to said crank shaft; and (f) changing a shape of said one or more actuator slots in said one or more reciprocating shafts.

Yet another aspect of the invention provides an internal combustion engine comprising one or more rotary-to-linear motion converters according to the invention.

The invention meets other goals and has other advantages which will be readily apparent from the following detailed description of the preferred embodiment and accompanying drawings. Variations and modifications may be made to the invention without departing from the spirit and scope of the novel concepts of the disclosure.

DETAILED DESCRIPTION OF THE INVENTION

Figure 1A:
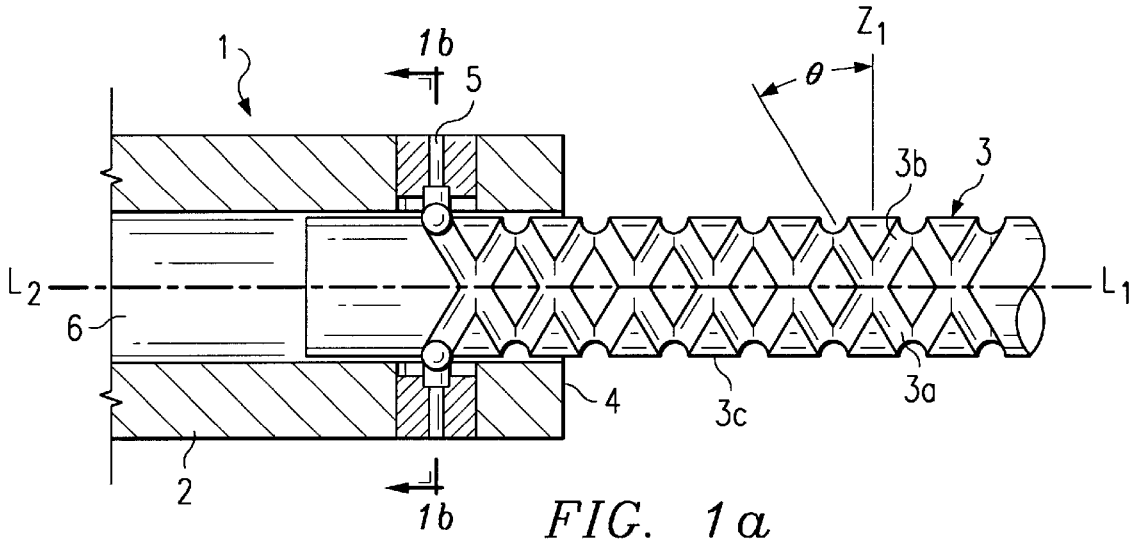
FIG. 1*a* is a partial cutaway side view of the reciprocating valve actuator-based device of the invention.

Referring now to FIG. 1, the rotary-to-linear converter, or yankee-type rotary-to-linear converter, according to the invention, converts the radial motion of a driver or camshaft into a linear motion of a reciprocating rod. Without being held down to a specific mode of operation, the rotary-to-linear converter of the invention (1) includes a rotating driver (2) which can rotate continually in a first radial direction about a longitudinal axis. At one end (4) of the rotating driver (2), there is a surface defining a bore (6) which is adapted to receive a first end (3*c*) of a reciprocating rod (3), a helical channel network comprising a first (3*a*) and second (3*b*) continuous, complementary, oppositely threaded, intersecting and opposing helical channels are disposed proximal the first end (3*c*) of the reciprocating rod (3). The helical channels (3*a* and 3*b*) are engaged with the rotating driver (2) by way of guide means (5) disposed adjacent the bore (6) of the rotating driver (2). The guide means (5) is further engaged with the rotating driver (2). The helical channels (3*a*) and (3*b*) which are disposed along an outer surface of the end (3*c*) comprise a helix angle (ϕ) wherein the helix angle (ϕ) is measured from an axis $Z_1$ which is substantially normal to and extends radially from a longitudinal axis $L_1$ along which the end (3*c*) of the reciprocating rod (3) extends. The helix angle (ϕ) can be varied to alter the ratio of revolutions per minute of the rotating driver per reciprocations per minute of the reciprocating rod (3). In a first embodiment, the helix angle (ϕ) ranges from about 35 to about 45°, preferably from about 35 to about 40°, and more preferably from about 38 to a bout 39° and is most preferably about 38.6°.

Figure 1B:
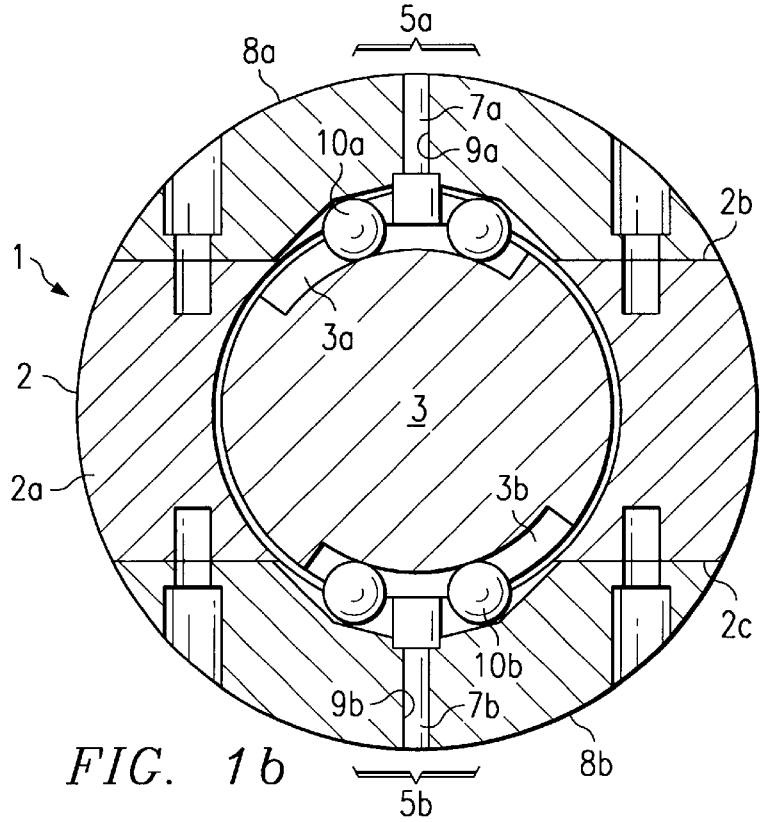
FIG. 1*b* is a cutaway end view, along line 1*b*—1*b*, of the device of FIG. 1.

FIG. 1*b* is a cross sectional elevation end view of the rotary-to-linear converter (1) of FIG. 1*a*. The rotating driver (2) comprises a partially reduced diameter portion (2*a*) which is defined by substantially opposing surfaces (2*b*) and (2*c*) which form corresponding channels or grooves in the rotating driver (2). The channels in the rotating driver (2) are disposed substantially radially opposite one another about the longitudinal axis $L_2$ about which the rotating driver $L_1$ is disposed and along which it extends. The channels also intersect with the bore (6).

According to the embodiment of FIG. 1*b*, the guide means (5) comprises a first guide member (5*a*) and a second guide member (5*b*). Each of the guide members (5*a*) and (5*b*) comprises a retaining bracket (8*a*) and (8*b*), respectively, and a dog (7*a*) and (7*b*), respectively. The dogs (7*a*) and (7*b*) are disposed within bores (9*a*) and (9*b*), respectively, which extend radially substantially normal to the longitudinal axis $L_2$. The dogs (7*a*) and (7*b*) are shown slidably engaged with the helical channels (3*a*) and (3*b*), respectively, and rotatably engaged with the retaining brackets (8*a*) and (8*b*), respectively. In the present embodiment, the retaining brackets (8*a*) and (8*b*) are fixedly engaged to the rotating driver (2). In another embodiment, the dogs (7*a*) and (7*b*) can be substantially free floating within although retained and confined by the retaining brackets (8*a*) and (8*b*).

Figure 2A:
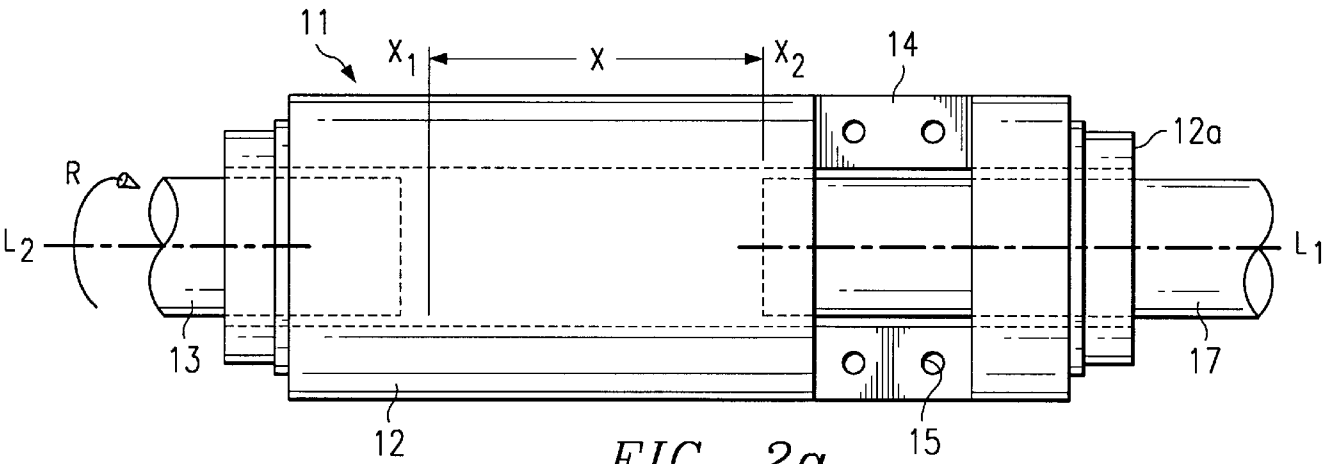
FIG. 2*a* is a top plan view of the device of the invention.

Referring now to FIG. 2*a*, the present invention provides a linear motion to rotary motion converter (11) comprising a drive collar (12), a rotating driver (13), a reciprocating rod (17) and guide means (not shown). For simplicity of drawing, the helical channel network on the reciprocating rod (17) and the guide means have not been shown; however, such elements are included in the embodiment of FIG. 2*a*. During operation, a rotating driver (13) rotates about a longitudinal axis $L_2$ in the direction indicated by the arrow R. The drive collar (12), which is engaged with the rotating driver (13), also rotates about the same longitudinal axis $L_2$ causing the guide means (not shown) to rotate about the reciprocating rod (17) such that the reciprocating rod (17) will reciprocate along a longitudinal axis $L_1$ in the direction indicated by the arrow X from a first position $X_1$ to a second position $X_2$. In the embodiment of FIG. 2*a*, a single 360° revolution of the drive collar (12) will cause a single full reciprocation of the reciprocating rod (17) from position $X_1$ to $X_2$ and back to $X_1$. Although not shown, the guide means is engaged with the coupler (12) at the channel (14). The guide means can be fixedly engaged by way of fixing means (15) to the drive collar (12). The driver(13) can be a camshaft, and the drive collar (12) can be fixedly engaged thereto.

Figure 2B:
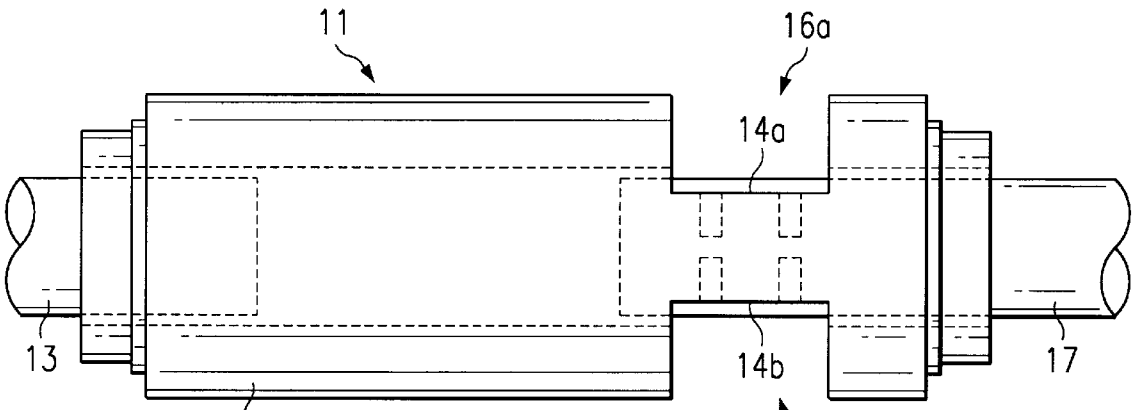
FIG. 2*b* is a side elevation view of the device of the invention.

FIGS. 2*a* and 2*b* depict a rotary-to-linear converter (11) comprising a drive collar (12) having a bore with an internal diameter slightly larger than the external diameter of a reciprocating rod (17). For the sake of illustration, the difference between the collar bore and the rod diameter is exaggerated. A telescoping relation is maintained between the drive collar (12) and reciprocating rod (17). A shoulder is formed in the drive collar (12) to form a reduced diameter portion (12*a*). The shoulder/reduced diameter portions accept journal bearings (not shown) that fit into a drive housing in an engine, supporting the drive collar (12). The surfaces (12*a*) ensure that any axial loads are born by the interior, axial load-bearing portion of the journal bearings, rather than the outer casings of the journal bearings.

Figure 3A:
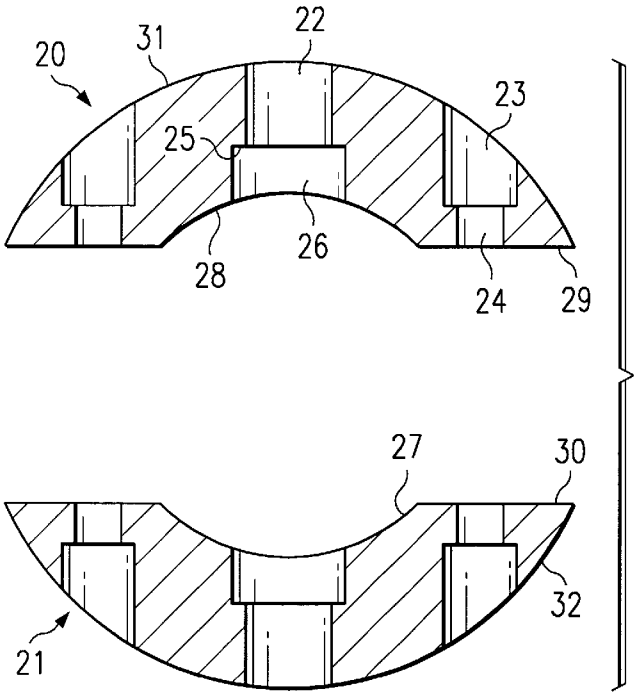
FIG. 3*a* is a cutaway end view of inserts used in the device of FIGS. 2*a*–2*b*.
Figure 3B:
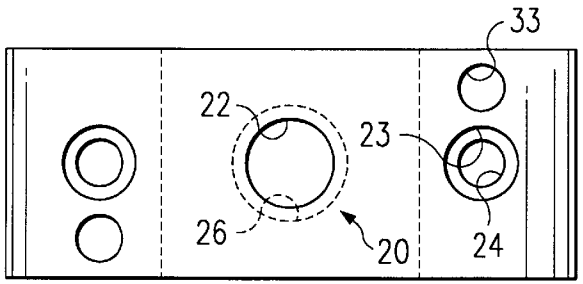
FIG. 3*b* is a top view of inserts used in the device of FIGS. 2*a*–2*b*.

Identical rectangular notches or channels (16*a*) and (16*b*) are formed on opposite sides of the drive collar (12) to accept the retaining brackets (20) and (21) shown in FIGS. 3*a* and 3*b*. These notches intersect the bore diameter for the reciprocating rod (17). Thus, when the rod (17) is inside the bore (6) of the drive collar (12), the rod (17) is exposed at the notches (16*a*) and (16*b*). The hole (22) is drilled through the retaining bracket (20) to accept the dog (7*a*) which is described in detail below. The hole (22) is counter-sunk as shown to accept a matching shoulder formed in the dog's shaft, and to retain the dog (7*a*). The holes (23) are tapped in the retaining bracket (20) to accept screws (not shown) that attach it to the drive collar (12). These holes match identical holes (15) tapped in the drive collar. The holes (23) are counter-sunk to accept screw heads. The hole (15) can include dowel holes drilled into the bracket (20) and drive collar (12) to accept dowels (not shown) which align the insert with the drive collar.

FIG. 2*b* depicts a side elevation view of the rotary-to-linear converter of FIG. 2*a* wherein a first surface (14*a*) and a radially opposing second surface (14*b*) of the coupler (12) define a first channel (16*a*) and a second channel (16*b*), respectively, wherein the guide means is disposed.

The guide means used in the rotary-to-linear converter of the invention can comprise one or more retaining brackets which retain at least one or one or more dogs adjacent to and engaged with the helical channel network disposed on the surface of one end of a reciprocating rod. FIG. 3*a* depicts a cross-sectional elevation side view of the retaining brackets (20) and (21). Each retaining bracket (20) and (21) will comprise a cavity (26) which is adapted to receive the dog (not shown) and which cavity (26) is adapted to permit movement of the dog when in use. The retaining bracket (20) can comprise one or more surfaces (29) which engage the surface (14*a*) of the drive collar (12) of FIG. 2*b*. Each retaining bracket can further comprise at least one and preferably two or more bores which are adapted to receive screws to aid in fixedly engaging the retaining bracket with the drive collar (12) or the rotating driver (13) of the invention. In a preferred embodiment, the dog (not shown) will be rotatably engaged with the bore (22) in the retaining bracket (20) to permit rotation of the dog during use. FIG. 3 depicts a top plan view of the retaining bracket (20), the bores (33) and (24) can be adapted to receive screws and/or dowels such that a screw or dowel placed therein will engage corresponding and complementary bores (15) (see FIG. 2*a*). The bores (23) and (26) can be counter-sunk to accommodate a screw head (not shown) and dog (7*a*) or (7*b*), respectively.

In the preferred embodiment, the rotary-to-linear converter is used in an internal combustion engine comprising two reciprocating rods and two drive collars. The details of the rotative engagement between the drive collars and reciprocating rods is the same for each rod/collar combination used in the preferred embodiment; therefore, a detailed description of only one set will be offered. Both drive collars can be made of "A2" steel in the preferred embodiment.

Figure 4:
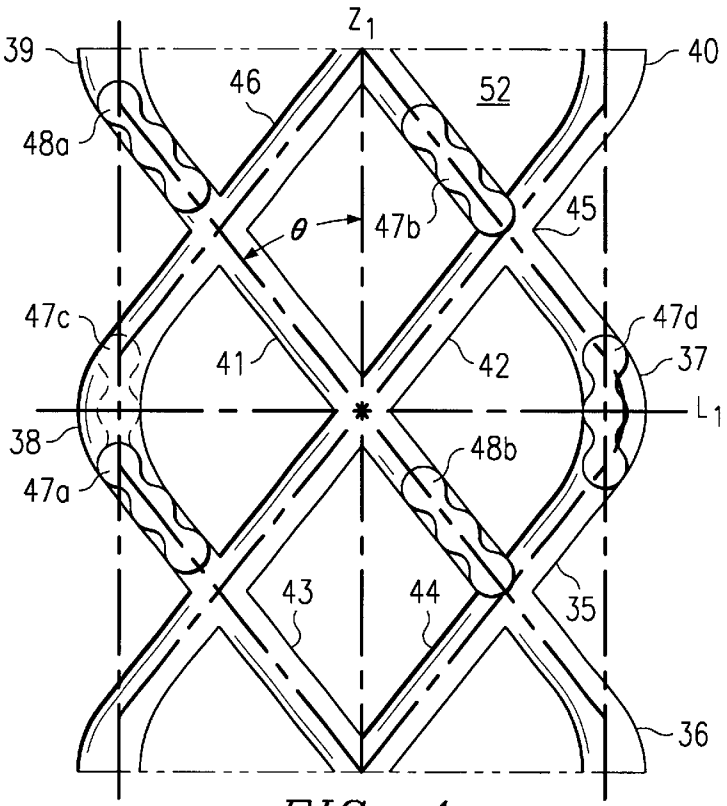
FIG. 4 is a developed view of the helical channel network of the device of FIG. 1.

FIG. 4 is a developed view of the helical channel network which comprises two continuous helical tracks (35) and (36) formed on the end of the reciprocating rod (52) (see FIG. 6*a*) and fit within the bore (58) of the drive collar (51). Still referring to FIG. 4, the first continuous helical track (35) forms a helix traversing the left most end of the reciprocating rod (52) in a first direction and then a second direction. The track (35) in a first right-hand threaded portion (43) having a helix angle ($\phi$) of about 38.6 degrees, a first turn-around point (38), a first left-hand threaded portion (46) having a helix angle ($\phi$) of about 38.6 degrees and a second smooth turn-around point (37) connected to the first right-hand threaded portion (43). The continuous helical track (36) is substantially complementary to, oppositely threaded as compared to and disposed oppositely from the first track (35). The second track (36) comprises a second left-hand threaded portion (42) having a helix angle of about 38.6 degrees, a third turn-around point (40), a second right-hand threaded portion (41) having a helix angle of about 38.6 degrees, a fourth turn-around point (39), and a second left-hand threaded portion (42).

The helix angle ($\phi$) can be varied as desired. In a preferred embodiment, the helix angle is about 35 to 40 degrees corresponding to a 55 to 50 degree pitch. The helical tracks (35) and (36) are of equal length and are substantial mirror images of one another.

In a preferred embodiment, the diameter of the reciprocating rod (3) is about 1–1.5 inches, and it is made of "A2" steel.

As the drive collar (51) is rotated about the longitudinal axis $L_1$, the dogs (47*a*) and (48*a*) course through their respective helical tracks (35) and (36) causing the linear reciprocation of the rod (52). The dogs (47*a*) and (48*a*) travel through their respective turn-around points (38) and (39) and rotate about an axis as they do so. As the dogs (47*a*) and (48*a*) travel to their respective positions (47*b*) and (48*b*), they maintain their same opposite and relative positions to one another.

At the turn-around points (37, 38) and (39, 40), the tracks (35) and (36), respectively, are wider than they are along the tracks' respective linear portions (43, 46) and (42, 44). This extra width is necessary since the dogs (47*a*) and (48*a*) are elongated members. The tracks are cut narrow enough at the apex—or midpoint—of the turn-around points (37, 38) and (39, 40) such that at least two, and preferably three, portions of each dog (47*a*) and (48*a*) will contact the channels (35) and (36). The spherical end portions of the dogs (47*a*) and (48*a*) will contact the outermost portions of the turn-around points (37, 38) and (39, 40), respectively. The middle portion of the dogs (47*a*) and (48*a*) will contact the innermost portions of the turn-around points (38, 38) and (39, 40), respectively. It will be understood upon review of FIG. 4 that the rounded ends of the dog of the invention will be spaced apart a sufficient distance such that when the center of a dog is placed at the center of the intersection between the helical tracks, the first end of the ends of the dogs will extend a distance greater than the width of the helical channel. In a more particular embodiment, the distance between a first tip of the first rounded end to an opposing second tip of the second rounded end will be at least twice and preferably at least three times the width of either of the rounded ends.

FIGS. 5*a*–5*f* depict various embodiments of the dog which is used as a guide means in the rotary-to-linear converter of the invention. The dog (60) of FIG. 5*a* comprises a central rod having a first reduced diameter portion (63) and a second larger diameter portion (64). First and second rounded portions (61) and (62) are disposed substantially opposite from one another and extend radially from the second larger diameter portion (64). When the dog (60) is engaged with a continuous helical track on a reciprocating rod, the rounded portions (61) and (62), and preferably also the second larger diameter portion (64), contact a surface which defines the helical track. Although the rounded portions (61) and (62) are depicted as being substantially spheroidal, they can be also shaped as a horseshoe, quarter moon, elongated ball, ellipsoid, or paraboloid. In preferred embodiments, the rounded portions (61) and (62) will have rounded ends. The shoulder (70) formed by the first and second diameter portions (63) and (64) is rotatably engaged with a complementary shoulder (25) in the countersunk bore (26) of FIG. 3*a*. The reduced diameter portion (63) is rotatably engaged with the bore (22) of the retaining bracket (20) depicted in FIG. 3*a*. When the dog (60) is rotatably engaged with the retaining bracket (20), the rounded portions (61) and (62) and a portion of the larger diameter portion (64) will fall within a cavity defined by the surface (28) of the retaining bracket (20) in FIG. 3*a*.

Figure 5A:
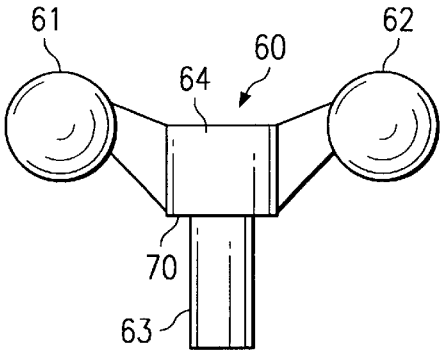
FIG. 5*a* is a side elevation view of a first embodiment of one of the dogs used in the device of the invention.
Figure 5C:
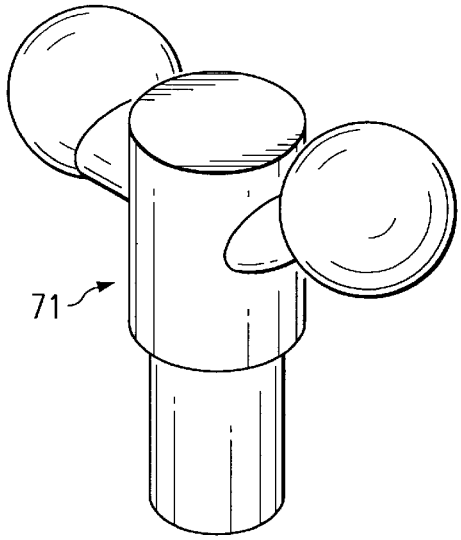
FIG. 5*c* is a perspective view of the dog of FIG. 5*a*.
Figure 5B:
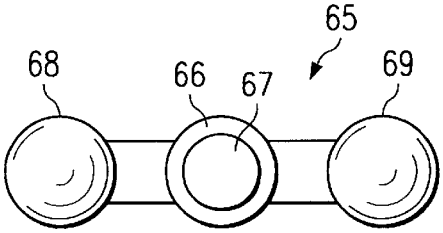
FIG. 5*b* is a top plan view of the dog of FIG. 5*a*.
Figure 5D:
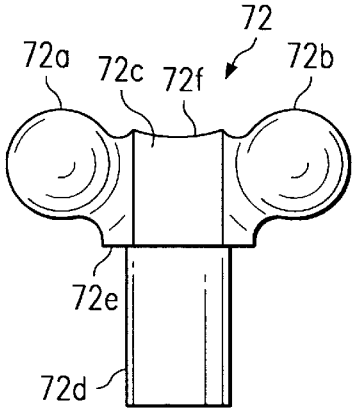
FIG. 5*d* is a side elevation view of a second embodiment of the dog of the invention.

FIG. 5*b* depicts a dog (65) according to the invention comprising rounded portions (68) and (69) and larger diameter portions (66) which forms a perimeter collar about the reduced diameter portion (67) which acts as a central shaft onto which the larger diameter portion (66) is mounted. FIG. 5*c* depicts a perspective view of an alternate embodiment of the dog (71) according to the invention. FIG. 5*d* depicts a second alternate embodiment of the dog (72) according to the invention wherein the rounded portions (72*a*) and (72*b*) are attached to the central portion (72*c*) which has a slightly concave surface (72*f*) at an end which opposes the shoulder (72*e*) and which is distal from the shaft (72*d*). In this embodiment, the concave surface (72*f*) has an arcuate shape that is substantially complementary to that of the inner surface of a helical track found on the reciprocating rod used in the device of the invention.

Figure 5E:
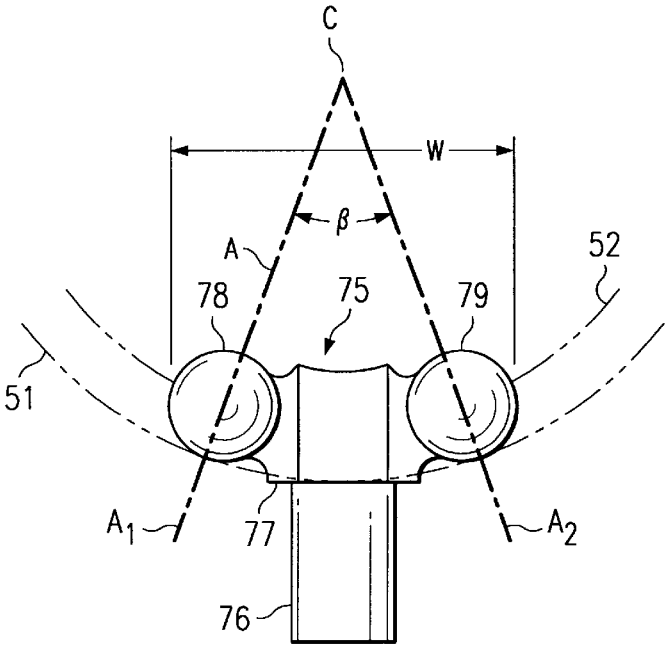
FIG. 5*e* is a side elevation view of a third embodiment of the dog of the invention.

FIG. 5*e* depicts the dog (75) which comprises the center shaft (76) and the larger diameter portion which forms the shoulder (77). The dog (75) further comprises rounded portions (78) and (79) which substantially oppose one another and extend radially from the center shaft (76). In relation to one another, the rounded portions (78) and (79) are spaced from one another along an arch which is defined by the rotation of an axis (A) from a first postion $A_1$ to a second postion $A_2$ about a centric point (C). The centric point (C) can be that point which is the radial center of the reciprocating rod (52) or the rotating drive collar (51) depicted in FIGS. 6*a* and 6*b*. The angle of rotation (β) can be varied as desired but will generally fall within a range that will result in an overall dog width (W) which permits the dog to pass smoothly through the cross-over points (45) and turn-around points (37) of the helical channel network according to the invention.

Figure 5F:
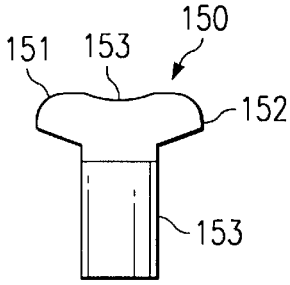
FIG. 5*f* is a side elevation view of a fourth embodiment of the dog of the invention.
Figure 13C:
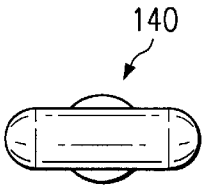
FIG. 13*c* is a front elevation view of the dog of FIG. 13*a*.
Figure 13B:
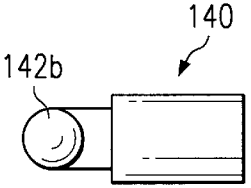
FIG. 13*b* is a side elevation view of the dog of FIG. 13*a*.
Figure 13A:
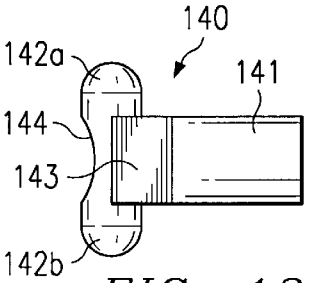
FIG. 13*a* is a top plan view of a fifth embodiment of a dog according to the invention.

While the dogs depicted in the drawings thus far include shaft portions that are narrower than their body portions, the present invention also includes dogs having shaft portions with diameters that approximate the diameter of their cylindrical body portions. FIG. 5*f* depicts a dog (150) comprising a substantially cylindrical shaft (153) and two opposing rounded ends (151, 152). Interposed the ends (151) and (152) is an arcuate portion (153) which is substantially complementary to a surface of the helical channel with which the dog is engaged. FIGS. 13*a*–13*c* depict a dog (140) comprising a shaft portion (141) having a diameter which approximates the diameter of a cylindrical body portion (143), which body portion (143) comprises two rounded ends (142*a*, 142*b*) and an arcuate portion (144) which is substantially complementary to an interior surface of a helical channel (not shown) in a drive collar (not shown).

Figure 6A:
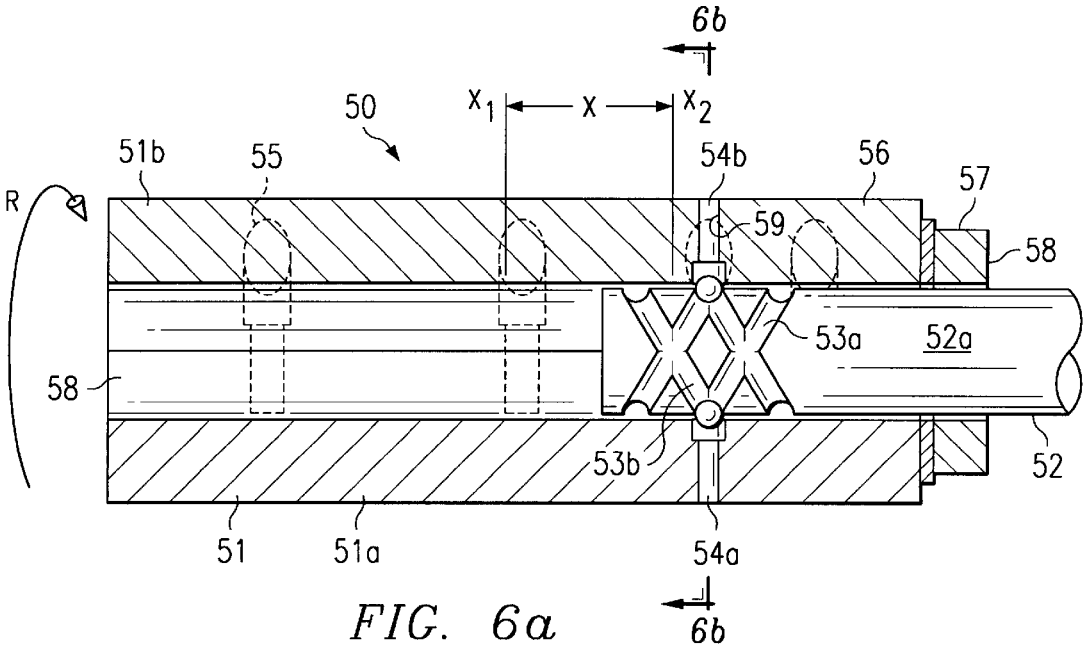
FIG. 6*a* is a partial cutaway side view of a second embodiment of a rotary-to-linear converter according to the invention.

FIG. 6*a* depicts a second embodiment of the rotary-to-linear converter (50) which comprises a rotating drive collar (51), a reciprocating rod (52) and two drive means (54*a*) and (54*b*). The drive collar (51) comprises a first half (51*a*) and a complementary and similarly shaped second half (51*b*) which when placed together have an inner surface defining a bore (58) through which a first end (52*a*) of the reciprocating rod (52*b*) reciprocates. Each of the first (51*a*) and second (51*b*) halves of the drive collar (51*a*) has a bore (59) which is countersunk such that the larger diameter portion of the countersunk bore intersects with the bore (58) of the drive collar (51). Disposed on an outer surface of the end (52*a*) of the reciprocating rod (52) is a helical channel network comprising first (53*a*) and second (53*b*) complementary, opposing and continuous helical tracks which are slidably engaged with the guide means (54*a*) and (54*b*). The guide means (54*a*) and (54*b*) each comprises a single dog according to the invention.

Figure 6B:
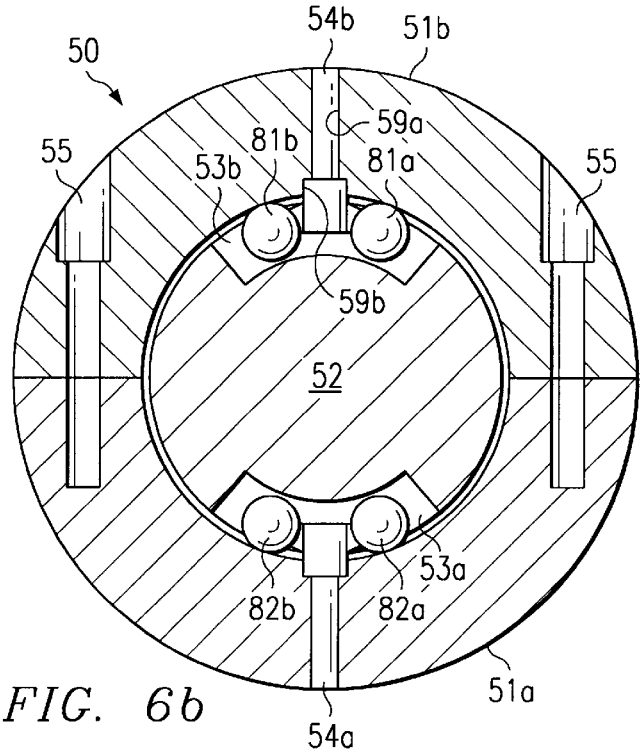
FIG. 6*b* is a cutaway end view, along line 6*b*—6*b*, of the device of FIG. 6*a*.

Depicted in FIG. 6*b* is a cross-sectional view along lines 6*b*—6*b* of the linear-to-rotary converter (50) of FIG. 6*a*. The first (51*a*) and second (51*b*) halves of the drive collar (51) are held together by screws (not shown) which can be placed in the countersunk bores (55). While the screws in the countersunk bores are used as attachment means, any attachment means known to those of skill in the art which are used for the attachment or connection of two solid bodies can be used herein. For example, devices such as clamps, pins, sleeves and combinations thereof could be used to maintain the halves of the drive collar together.

The reciprocating rod (52) comprises a first helical channel (53*a*) and the opposing second helical channel (53*b*). The rounded portions (81*a*, 81*b*) and (81*a*, 82*b*) of the dogs (54*b*) and (54*a*), respectively, are substantially completely disposed within the helical channels (53*b*) and (53*a*), respectively. It is not necessary that the bores (55) or (59) be countersunk. While the rotary-to-linear converter (50) depicted in FIGS. 6*a* and 6*b* does not comprise a retaining bracket to retain the dogs (54*a*) and (54*b*) engaged with the helical channel network (53) of reciprocating rod (52), it may be desirable to further include an adjustment means which can control the disposition of the dogs (54*a*) and (54*b*) relative to either one or both the drive collar (51) or the reciprocating shaft (52).

Referring now to FIG. 6*a*, two continuous helical tracks, (53*a*) and (53*b*), are formed on the end of the reciprocating rod (52) and fit within the bore (58) of the drive collar (51). The continuous helical track (53*a*) forms a helix traversing the left most end of reciprocating rod (52) in a first direction, and then an opposing second direction. The track (53*a*) comprises a first right-hand threaded portion having a helix angle of about 38.6 degrees, a first smooth turn-around point, a first left-hand threaded portion having a helix angle of about 38.6 degrees and a second smooth turn-around point which is connected to the first right-hand threaded portion. In a similar but opposing manner, the continuous helical track (53*b*) also forms a helix traversing the left most end of reciprocating rod (52). The track (53*b*) comprises a second left-hand threaded portion having a helix angle of about 38.6 degrees, a third smooth turn-around point, a second right-hand threaded portion having a helix angle of about 38.6 degrees, and a fourth smooth turn-around point which is connected to the second left-hand threaded portion. The helical tracks (53*a*) and (53*b*) are complemetary, diametrically opposed and of equal length. They form mirror images of each other.

Figures 9, 10:
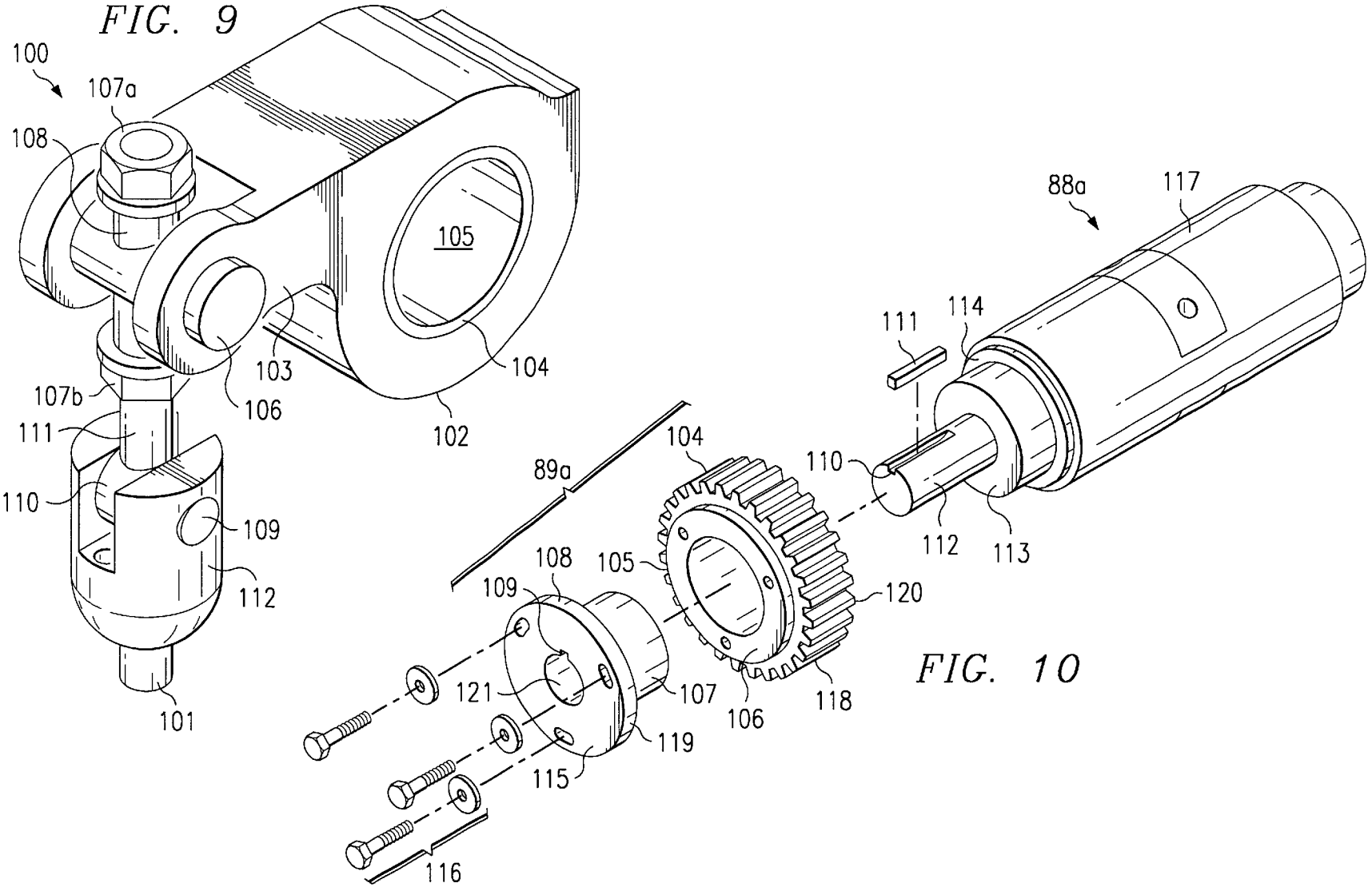
FIG. 9 is a perspective view of a rocker connected to the stem of a reciprocating valve.
FIG. 10 is an exploded view of the adjustment mechanism used to vary the timing between engaged adjacent rotary-to-linear converters, i.e. the primary and slave drives.

The rotary-to-linear motion converter of the invention can be incorporated into an internal combustion engine by replacement of the cam and rocker arm assembly in a conventional engine with the cam, block, rotary-to-linear converter and rocker arm assemblies according to the present invention. Referring now to FIG. 10, the valve actuator device (80) is adapted to operate on a four cylinder eight valve engine and comprises first (81) and second (82) linearly reciprocating cams, plural support stanchions (85*a* and 85*b*, and 86*a*–86*h*, a first set of rocker arms (83*a*–83*d*) operably engaged with a first cam (81), a second set of rocker arms (84*a*–84*d*) operably engaged with the second cam (82), a first rotary-to-linear motion converter (88*a*) operably engaged with the first cam (81), a second rotary-to-linear motion converter (88*b*) operably engaged with the second cam (82), a first drive (89*a*) operably engaged with the first rotary-to-linear converter (88*a*), and a second drive (89*b*) operably engaged with the second rotary-to-linear motion converter (88*b*).

The stanchions (85*a*, 85*b*, 86*a*–86*h*) are shown fixedly engaged to a support plate (90) which is fixedly engaged with the engine block of the internal combustion engine (not shown). The support stanchions (85*a*, 85*b*) support the rotary-to-linear converters (88*a*, 88*b*) and can comprise lubricated bushings or bearings to minimize friction between the converters (88*a*, 88*b*), the reciprocating rods (81, 82) and the support stanchions (85*a*, 85*b*. The support stanchions (86*a*–86*h*) provide sliding support and lubrication for the reciprocating rods (81, 82), and constrain the rockers (84*a*–84*d*) and (83*a*–83*d*) from linear movement. Each support stanchion has a linear hole through which a respective reciprocating rod (81, 82) reciprocates. The holes in the support stanchions (86*a*–86*h*) can comprise lubricated bushings disposed therein to minimize the friction between the reciprocating rod and the support stanchion. The reciprocating rods (81) and (82) are slidably engaged with the support stanchions (86*a*–86*h*) and are telescopically, or linearly reciprocatingly, engaged with the linear-to-rotary converters (88*a*) and (88*b*), respectively. The bushings of the stanchions can be lubricated passively by allowing oil to drip on the entire device during operation or actively by forcing oil into the bushings or holes of the stanchions by way of lubrication ports (not shown).

Figure 8:
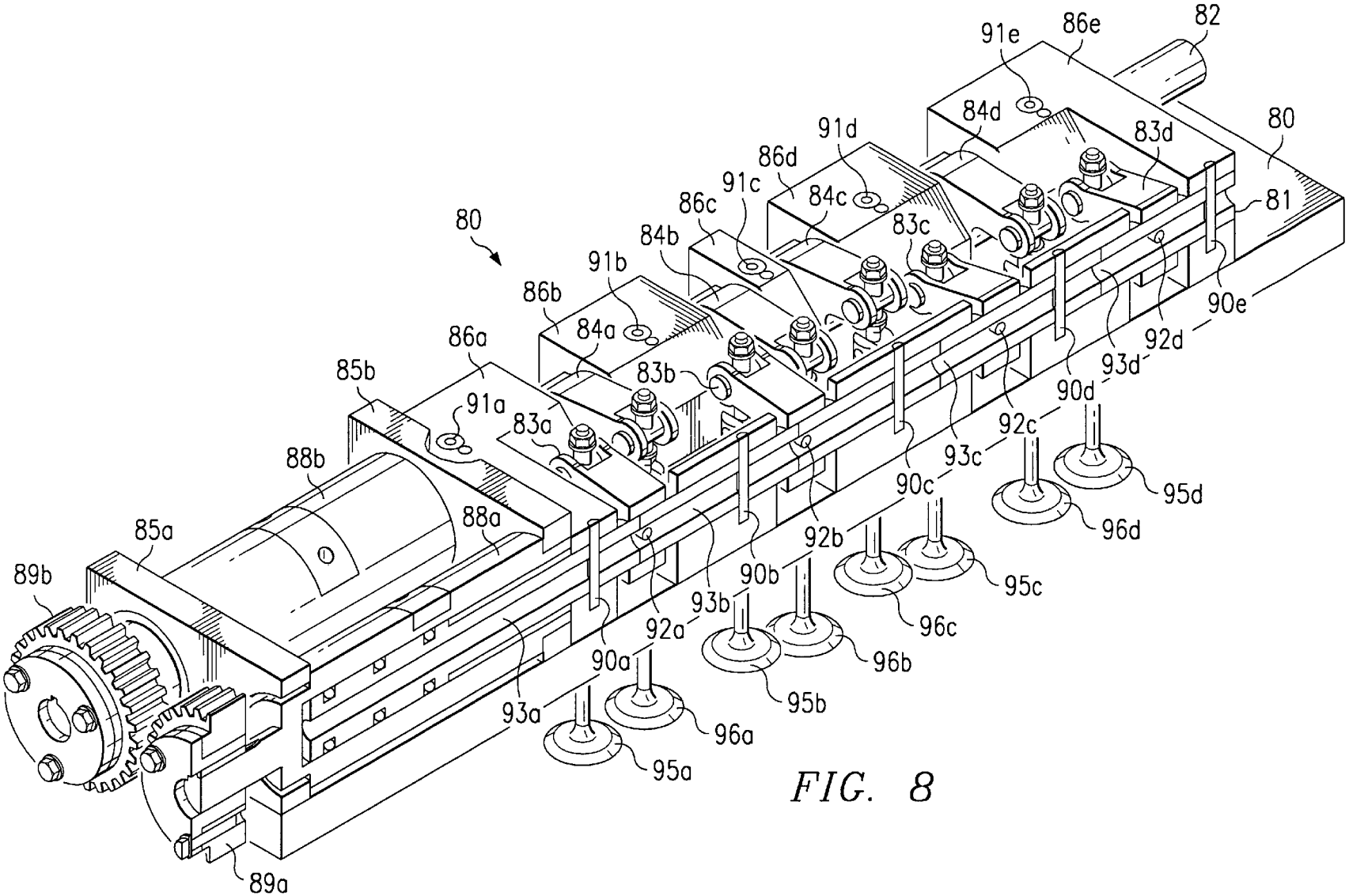
FIG. 8 is a cutaway side view, along lines 8—8 of the reciprocating valve actuator device of FIG. 7.

FIG. 8 depicts a sectional view of the valve actuator device (80) along lines 8—8 of FIG. 8. The reciprocating rod (81) is shown slidably engaged with rockers (83*a*–83*d*), stanchions (86*f*–86*h*) and the rotary-to-linear motion converter (88*a*). The reciprocating rod (81) is operably engaged with the rockers (83*a*–83*d*) by way of actuator pins (92*a*–92*d*), respectively, and actuator slots (93*a*–93*d*), respectively, in the reciprocating rod (81). The rocker pins (92*a*–92*d*) are slidably engaged with the actuator slots (93*a*–93*d*), respectively. Each rocker (83*a*–83*d*) comprises a bore (94*a*–94*d*), respectively, by which each rocker is pivotally mounted and slidably engaged with the reciprocating rod (81).

The rockers (83*a*–83*d*) and (84*a*–84*d*) are engaged with the valve stems of the respective valves (95*a*–95*d*) and (96*a*–96*d*). Accordingly, the reciprocating rod (81) actuates the intake valves (95*a*, 95*b*) and the exhaust valves (95*c*, 95*d*). In much the same manner, the reciprocating rod (82) actuates the exhaust valves (96*a*, 96*b*) and the intake valves (96*c*, 96*d*).

During operation, the drive (89*a*) rotate the rotary-to-linear motion converter (88*a*) which reciprocates the reciprocating rod (81) which rocks the rockers (83*a*–83*d*) and thereby actuates the valves (95*a*–95*d*). The actuator pins (92*a*–92*d*) extend completely through their respective portions of the reciprocating rod (81), and each actuator pin (92*a*–92*d*) is engaged with its respective rocker (83*a*–83*d*). The actuator pins can be fixedly or rotatably engaged with their respective rockers.

The engagement between the linear-to-rotary converter (88*a*) and the reciprocating rod (81) may have a tendency to cause a slight rotation of the reciprocating rod about its linear axis. In order to minimize and/or eliminate any rotation of the reciprocating rod about its linear axis, the valve actuator device of the invention includes stabilizing pins (90*a*–90*d*) which are engaged with their respective support stanchions (86*a*, 86*f*, 86*g* and 86*h*). The stabilization pins extend completely through the reciprocating rod (81) in a direction substantially normal to the direction of penetration of the actuator pins (92*a*–92*d*). The stabilization pins (93*a*–93*d*) can be fixedly or rotatably engaged with their respective stanchions, and, if necessary, keepers such as (91*a*–91*e*) can be used to keep the stabilization pins engaged with their respective stanchions.

The drive (89*a*) is engaged with a transmission shaft of an internal combustion engine by way of a gear in a substantially one-to-one gear ratio whereby the drive (89*a*) can rotate at about the same speed as the gear of the internal combustion engine and consequently at about the same speed as a crankshaft of the internal combustion engine. In use, the drive (89*a*) is directly engaged to the gear of the engine while the drive (89*b*) acts as a slave gear which is controlled by the drive (89*a*). The drives (89*a*) and (89*b*) are supported by journal bearings (not shown) which are disposed within the stanchion (85*a*). Bushings or other types of bearings can be used in place of the journal bearings.

In operation, a gear (not shown) of an internal combustion engine engages and rotates the drive (89*a*) which is the master gear. The drive (89*a*) engages the drive (89*b*) which is the slave gear so that the drive (89*b*) turns with substantially the same speed but in the opposite direction of the drive (89*a*). The drive (89*a*) rotates the drive collar (117) of the linear-to-rotation motion converter (88*a*) which forces the reciprocating rod (81) to reciprocate telescopically in and out of the drive collar (117). In the same manner, the drive (89*b*) forces the linear reciprocation of the reciprocating rod (82).

Each rocker is affixed to a valve stem by way of a connector assembly (100) as depicted in FIG. 9. The rocker (102) comprises a bore (105) through which the reciprocating rod (not shown) is pivotally engaged, a bushing or bearing (104) disposed in the bore (105) for reducing wear between the rocker (102) and the reciprocating rod, and a rocker arm (103) which is pivotally engaged with the valve stem (101). The rocker arm (103) is engaged with a mounting pin (106) which comprises a first rod-shaped portion directly engaged with the rocker arm and a second cylindrical portion substantially perpendicular to the rod-shaped portion through which a connector assembly shaft (111) passes. The connector assembly shaft (111) comprises a first threaded portion threadably engaged with a first nut (107*a*) and a second threaded portion threadably engaged with a second nut (107*b*). The cylindrical portion (108) of the mounting pin (106) is disposed between the nuts (107*a*, 107*b*). At a second end of the connector assembly shaft (111), there is disposed a collar (110) comprising a bore that extends substantially perpendicular to the linear axis of the connector assembly shaft (111). The valve stem (101) is engaged with a collar adaptor (112) which is engaged with a mounting pin (109) that is pivotally engaged with the collar (110). When assembled, the connector assembly allows each rocker to open and close its respective valve by an arcuate movement of the actuator about the axis of the reciprocating rod, thereby eliminating the need for return springs.

As the rocker arm (103) pivots about the linear axis of an operably engaged reciprocating rod (not shown), the rocker arm's motion defines an arcuate pathway. The pivotal engagement between the collar (110) and the pin (109) permits the valve stem (101) to reciprocate along its linear axis as the rocker arm (103) reciprocates along its arcuate path.

Referring now to FIG. 10, the rotary-to-linear converter (88*a*) comprises a drive collar (117) and a first end comprising a first shoulder (114) having a diameter narrower than the drive collar (117), a second shoulder (113) having a diameter narrower than the first shoulder (113) and a distal portion (112) having a diameter narrower than the second shoulder (113). The distal portion (112) has a notch (110) which is adapted to receive a pin (111). The drive (89*a*) comprises a first gear (104) and an end mount (108). The end mount (108) comprises an end plate (119) and a cylindrical collar (107) having a bore therethrough which bore comprises a notch (109). The gear (104) comprises a toothed radial outer surface (118), a first shoulder portion (105), and a longitudinally extending bore (106) therethrough which is adapted to receive the cylindrical collar (107). During use, the gear (104) is engaged with the shoulder (113) of the drive collar (117) and the cylindrical collar (107) of the end mount (108). The distal end (112) of the drive collar (117) is engaged with the bore (121) which extends through the end mount (108). Subsequently, the pin (111) is engaged with the notch (110) in the distal end (112) and the notch (109) in the bore (121). Finally, the end mount (108) is secured to the gear (104) by way of mounting screws and washers (116) which are mounted through slotted bores (115) in the end plate (119) and bores (120) in the gear. The slotted bores (115) permit radial adjustment of the gear (104) with respect to the end mount (108) and thereby allow for adjustment of the timing of an internal combustion engine using this assembly.

Figure 11A:
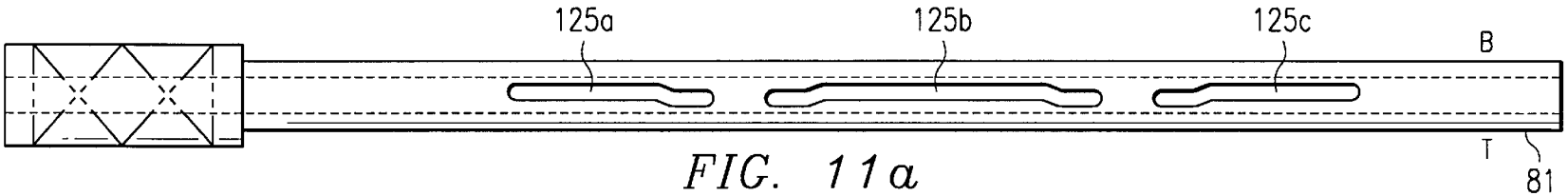
FIG. 11*a* is a right side elevation of a reciprocating rod according to the invention.
Figure 11B:
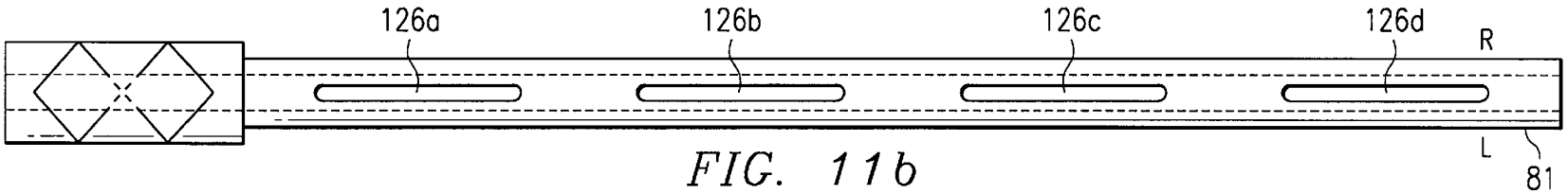
FIG. 11*b* is a top plan view of a reciprocating rod according to the invention.
Figure 11C:
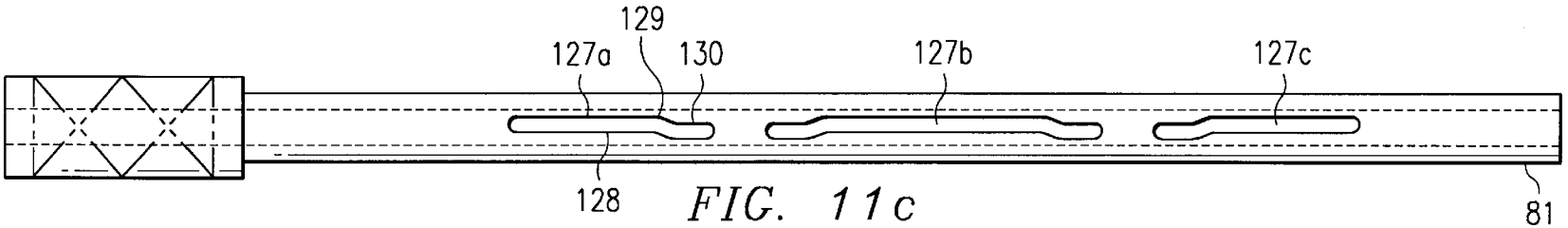
FIG. 11*c* is a left side elevation of a reciprocating rod according to the invention.
Figure 12A:
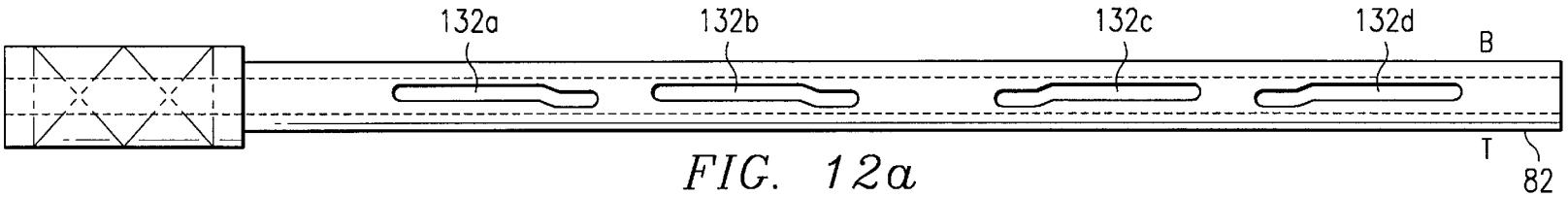
FIG. 12*a* is a right side elevation of a second reciprocating rod according to the invention.
Figure 12B:
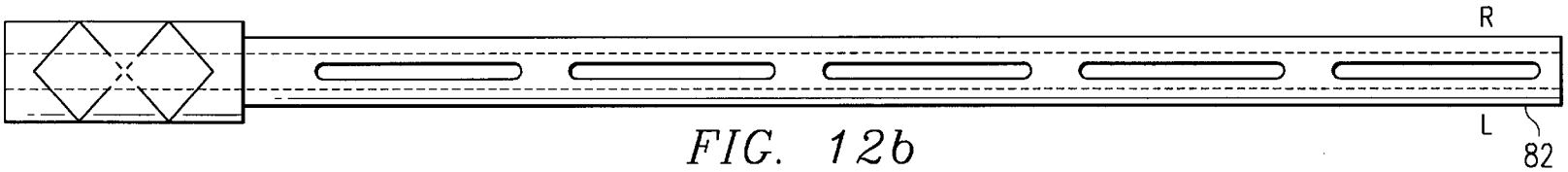
FIG. 12*b* is a bottom plan view of a second reciprocating rod according to the invention.
Figure 12C:
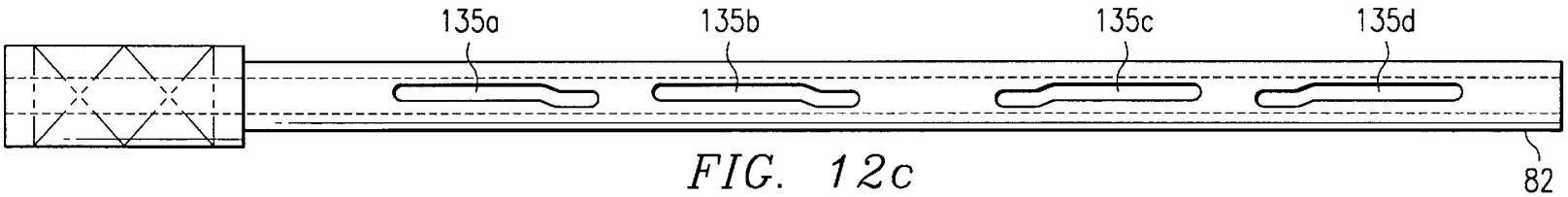
FIG. 12*c* is a left side elevation view of a second reciprocating rod according to the invention.

Referring now to FIGS. 11*a*–11*c* and 12*a*–12*c*, the details of the actuator slots in the reciprocating rods (81, 82) will now be described. Four pair of diametrically opposed actuator slots are cut in the front and back of each reciprocating rod and are sized to receive the actuator pins on each rocker. Each side of the reciprocating rod has four actuator slots. Each actuator slot has two levels connected by an angled channel. The front slots' upper level is paired with the back slots' lower level; the front slots' lower level is paired with the back slots' upper level. For example, FIG. 12*a* depicts a left side elevation of the reciprocating rod (82) which comprises the actuator slots (132*a*–132*d*), wherein (T) indicates the top of the rod and (B) indicates the bottom of the rod. FIG. 12*c* depicts a right side elevation of the reciprocating rod (82) which comprises the actuator slots (135*a*–135*d*) which slots are inverted mirror images of the slots (132*a*–132*d*).

Referring now to FIG. 11*c*, the angled channel (129) connecting the upper (130) and lower (128) levels of the slot (127*a*) forms an acceleration/deceleration angle of about 15°–45°, more preferably 25°–40°, with respect to the axis of the rod (81). Actuator slots (125*a*–125*c*) and (127*a*–127*c*) on the reciprocating rod (81) are adapted to receive the actuator pins (92*a*–92*d*) from the rockers (83*a*–83*d*), respectively. The actuator pins and actuator slots cooperate so that as the reciprocating rod slides through the rocker, the rocker is forced to rotate about the axis of the rod into one of two positions, raised or lowered. When an actuator pin of a rocker is disposed within an upper portion (130) of an actuator slot (127*a*), a valve engaged with the rocker will be in the open position. Conversely, when the actuator pin of a rocker is disposed with a lower portion (128) of an actuator slot (127*a*), a valve engaged with the rocker will be in the closed position.

As the reciprocating rods (81, 82) move back and forth through the rockers, each rocker rotates in response to its position along the actuator slots in the reciprocating rods. Thus, the actuator slots, valve positions, reciprocating rod positions and engine cooperate with the rotary-to-linear converter when the valve actuator device of the invention are installed in an engine. In one embodiment of the invention, the crankshaft turns 720°, or 2 complete revolutions for one full cycle of the engine, and for every 360° turn, the reciprocating rod will complete only ½ of a reciprocation cycle.

In yet another preferred embodiment, the opening and closing of the valves, in an engine employing the valve actuator device according to the invention, will overlap such that as a first intake valve is opening a first exhaust valve will be closing. The amount of overlap can be optimized by the skilled artisan by varying the engine timing.

Figure 7:
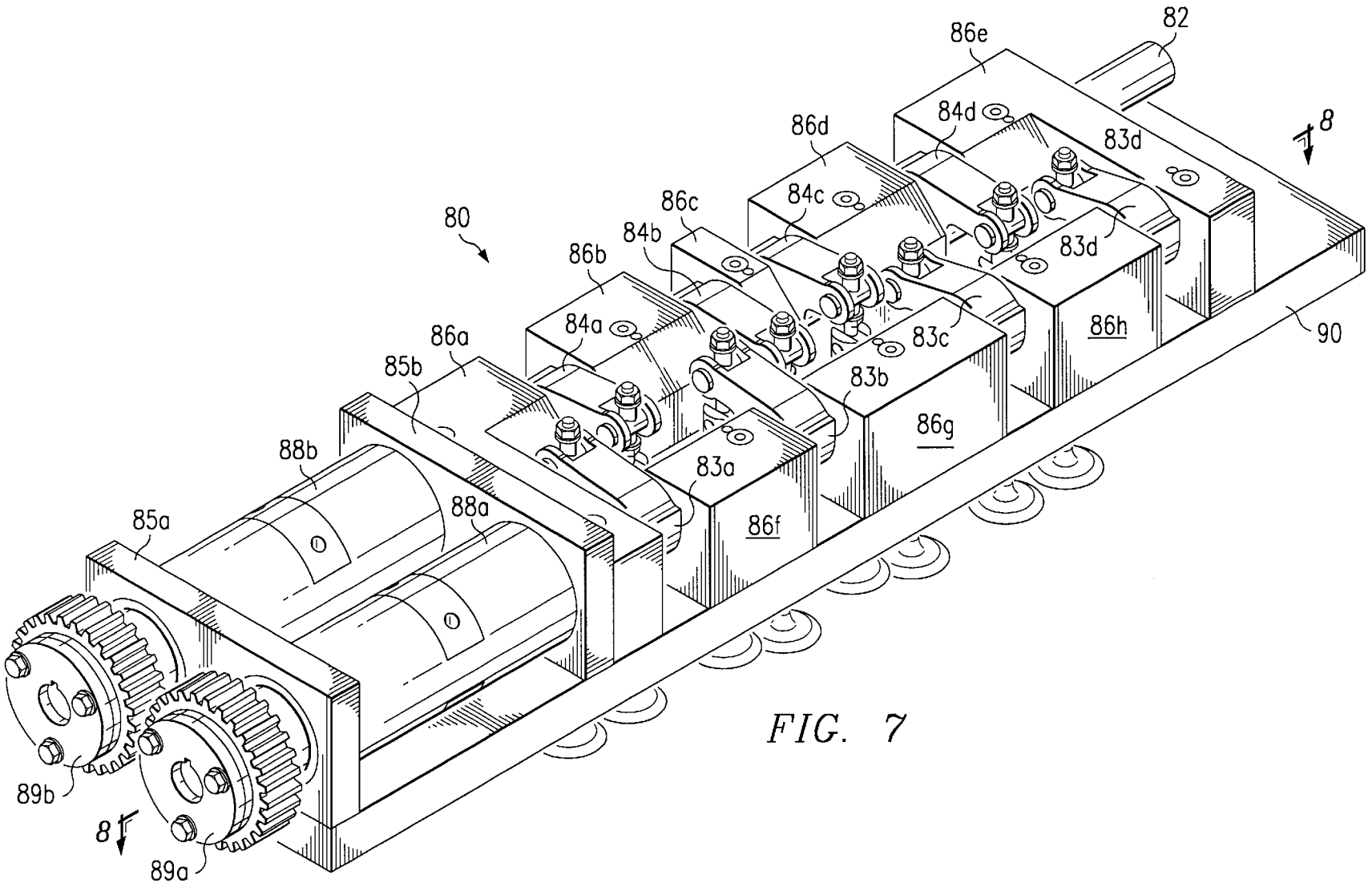
FIG. 7 is a perspective view of a reciprocating valve actuator device comprising two rotary-to-linear converters according to the invention operably engaged with 8 reciprocating valves.

The timing of an engine employing a rotary-to-linear motion converter or valve actuator device according to the invention can be adjusted by at least one of: 1) adjusting the engagement between the primary gear (89*a*) and the slave gear (89*b*) (FIG. 7) by employing the adjustment mechanism depicted in FIG. 10; 2) placing adjustable or fixed width bushings between the rockers and respectively adjacent stanchions (FIG. 7); 3) adjusting the disposition of a rocker arm (103) relative to a valve stem (101) by means of an adjustable connector (106, 107*a*–*b*, 108-111) (FIG. 9); 4) changing the helix angle (ϕ) of the helical channel network in the converter (FIG. 4); 5) changing the gear ratio of the primary gear (89*a*) relative to the crank shaft (not shown) of the engine; and 6) changing the angle or disposition of the angled channel (129) with respect to upper (130) or lower (128) portion of a respective actuator slot (127*a*).

It should be understood that various modifications can be made to the embodiment disclosed without departing from the spirit and scope of the present invention. Various engineering changes and choices can also be made without departing substantially from the spirit of the disclosure.

What is claimed is:

1. A valve actuator device of an internal combustion engine, the device comprising one or more rotary-to-linear motion converters each comprising:

(a) a reciprocating shaft extending along a first longitudinal axis and comprising a helical channel network on an outer surface of a first end and one or more actuator slots;

(b) a rotating driver extending along a second longitudinal axis, said driver having an inner surface defining a bore at one end for receiving said first end of said reciprocating shaft; and (c) guide means engaged with said helical channel network of said reciprocating shaft and with said rotating driver, said guide means comprising at least one dog including a shaft substantially perpendicular to said reciprocating shaft and a portion extending radially from said shaft wherein:

said first longitudinal axis is substantially collinear with said second longitudinal axis; and at least said first end of said reciprocating shaft reciprocates within said bore of said rotating driver along said longitudinal axes when said rotating driver is continually rotated about said second longitudinal axis in a first direction;

a base which is engageable with said internal combustion engine and onto which is mounted said one or more rotary-to-linear motion converters;

one or more rockers slidably, pivotingly and operably engaged with said one or more reciprocating shafts such that linear reciprocation of said one or more reciprocating shafts will cause said one or more rockers to reciprocate and pivot about said one or more shafts; and one or more connectors for operably engaging said one or more rockers to one or more valves in said internal combustion engine;

wherein, said one or more rotary-to-linear motion converters are operably engaged with a crankshaft of said internal combustion engine.

2. The valve actuator device of claim 1 wherein:

a first of said one or more rotary-to-linear motion converters is operably engaged with a drive shaft of said internal combustion engine, and a second of one or more rotary-to-linear motion converters is operably engaged with said first one or more rotary-to-linear converters.

3. The valve actuator device of claim 2, wherein a timing of opening and closing of said one or more valves can be changed by at least one of:

(a) adjusting an operable engagement between said first and second rotary to linear converters;

(b) displacing said one or more rockers with respect to said rotating drive collar;

(c) adjusting a length of said one or more connectors operably engaging said one or more rocker arms to said one or more valves;

(d) changing a helix angle of said helical channel network;

(e) changing a gear ratio of said first rotary-to-linear motion converter relative to said crank shaft; and (f) changing a shape of said one or more actuator slots in said one or more reciprocating shafts.

4. The valve actuator device of claim 1, wherein said internal combustion engine is a four cylinder engine.

5. The valve actuator device of claim 4 comprising:

two of said one or more rotary-to-linear converters;

eight of said one or more rockers;

eight of said one or more valves; and eight of said one or more connectors;

wherein, each of said reciprocating shafts comprises four pairs of actuator slots.

6. The valve actuator of claim 1, wherein at least one reciprocating shaft is hollow.

7. The valve actuator device of claim 6, wherein said one or more actuator slots include at least one pair of actuator slots.

8. The valve actuator device of claim 1, wherein at least one reciprocating shaft is made of A2 steel.

9. The valve actuator device of claim 1, wherein the rockers are engaged with the reciprocating shafts by a single pin through diametrically opposed actuator slots.

10. The valve actuator device of claim 1, wherein the helix angle is between 35 to 40 degrees.

11. The valve actuator device of claim 1, wherein the helix angle is about 38.6 degrees.

12. The valve actuator device of claim 1, wherein each reciprocating shaft has at least one stabilizer slot which cooperates with at least one stabilizer pin rigidly connected to the base.

13. The valve actuator device of claim 12, wherein the stabilizer slot is perpendicular to the actuator slots.

14. The valve actuator device of claim 1, wherein said one or more actuator slots include at least one pair of diametrically opposed actuator slots.

15. The valve actuator device of claim 14, wherein said diametrically opposed actuator slots include diametrically opposed actuator slots comprising two levels connected by an angled channel.

16. The valve actuator device of claim 15, wherein said diametrically opposed actuator slots comprising two levels include each said diametrically opposed actuator slot as an inverted mirror image of the other said diametrically opposed actuator slot.

17. The valve actuator device of claim 1, wherein said one or more actuator slots receive an actuator pin and wherein said actuator pin engages said one or more rockers.

18. The valve actuator device of claim 1, wherein said at least one dog includes two dogs.

19. The valve actuator device of claim 1, wherein said at least one dog includes at least one dog rotatably engaged through a borehole in said rotating driver.

20. The valve actuator device of claim 1, wherein said at least one dog includes a central shaft, a first portion disposed substantially opposite a second portion and wherein said first and second portions extend radially from said central shaft.

21. The valve actuator device of claim 20, wherein said first and second portions are substantially spheroidal.

22. The valve actuator device of claim 20, wherein said first and second portions are rounded.

23. The valve actuator device of claim 1, wherein said dog includes a first, second, and third contact point and wherein at least two of said first, second and third contact points contact said helical channel network.

24. The valve actuator device of claim 1, wherein said helical channel network includes at least one linear portion and at least one turn-around point.

25. The valve actuator device of claim 24, wherein said turn-around point is wider than said linear portion.

26. The valve actuator device of claim 1 wherein said one or more rockers further comprise:

a bore;

a bushing disposed in said bore, wherein said bushing slidably, pivotingly and operably engages said one or more reciprocating shafts; and a rocker arm offset from said bore, wherein said rocker arm operably engaging said one or more connectors.

27. The valve actuator device of claim 26, wherein said bushing includes actively lubricated bushings.

28. The valve actuator device of claim 1, wherein the connectors allow for arcuate movement of the rocker around the axis of the reciprocating shaft through a springless attachment means.

29. The valve actuator device of claim 28, wherein the springless attachment means comprises a receiver connected to an extension arm through a pivotal connection; the extension being pivotally connected to the rocker.

* * * * *